US010385589B2

(12) United States Patent
Matosian

(10) Patent No.: US 10,385,589 B2
(45) Date of Patent: Aug. 20, 2019

(54) ELECTRONIC DOOR LOCK

(71) Applicant: ASSA ABLOY Residential Group, Inc., New Haven, CT (US)

(72) Inventor: Daniel Matosian, Oxford, CT (US)

(73) Assignee: ASSA ABLOY Residential Group, Inc., New Haven, CT (US)

( * ) Notice: Subject to any disclaimer, the term of this patent is extended or adjusted under 35 U.S.C. 154(b) by 0 days.

(21) Appl. No.: 15/950,432

(22) Filed: Apr. 11, 2018

(65) Prior Publication Data

US 2018/0320412 A1 Nov. 8, 2018

Related U.S. Application Data

(60) Provisional application No. 62/501,367, filed on May 4, 2017.

(51) Int. Cl.

| | |
|---|---|
| ***E05B 37/00*** | (2006.01) |
| ***E05B 47/00*** | (2006.01) |
| ***E05B 47/06*** | (2006.01) |
| ***E05B 49/00*** | (2006.01) |
| ***E05B 51/00*** | (2006.01) |

(52) U.S. Cl.

CPC ..... *E05B 49/00* (2013.01); *E05B 37/0044* (2013.01); *E05B 37/0072* (2013.01); *E05B 47/0012* (2013.01); *E05B 47/0615* (2013.01); *E05B 47/0676* (2013.01); *E05B 51/00* (2013.01); *E05B 2047/0056* (2013.01); *E05B 2047/0081* (2013.01); *E05Y 2201/434* (2013.01); *E05Y 2400/44* (2013.01); *E05Y 2400/45* (2013.01); *E05Y 2400/612* (2013.01); *E05Y 2400/86* (2013.01); *E05Y 2900/132* (2013.01)

(58) Field of Classification Search

CPC ..... G07C 9/0069; B66B 1/461
USPC ..... 340/561
See application file for complete search history.

(56) References Cited

U.S. PATENT DOCUMENTS

| | | | | |
|---|---|---|---|---|
| 4,901,545 | A | 2/1990 | Bacon et al. | |
| 2004/0025550 | A1* | 2/2004 | Yamagishi | G07C 9/00563 70/278.1 |
| 2011/0252843 | A1* | 10/2011 | Sumcad | E05B 47/00 70/91 |
| 2015/0314986 | A1* | 11/2015 | Schwarzentruber | B66B 1/461 340/5.51 |
| 2016/0024823 | A1* | 1/2016 | McAndrew | G05B 15/02 70/263 |

(Continued)

*Primary Examiner* — Fabricio R Murillo Garcia
(74) *Attorney, Agent, or Firm* — Wolf, Greenfield & Sacks, P.C.

(57) ABSTRACT

An electric door lock uses an interface to receive a credential to disengage a door lock. The interface is disposed on the user-graspable handle. The interface may comprise a sensor that receives a credential, such as an alphanumeric or symbolic code, a biometric input, or any appropriate combination of inputs. After a credential is entered, a gesture may be input to the interface to indicate that the credential is complete and prompt a controller to disengage the lock device. A gesture may comprise a motion or series or motions. The electric door lock also provides a control system that can be networked to allow remote entry of a credential. The control system can also control a plurality of door handles through a single door, or provide controls through remote devices.

26 Claims, 5 Drawing Sheets

(56) References Cited

U.S. PATENT DOCUMENTS

2016/0133071 A1* 5/2016 Henderson ..... E05B 47/0001
70/277

* cited by examiner

ELECTRONIC DOOR LOCK

RELATED APPLICATIONS

This application claims the benefit under 35 U.S.C. § 119(e) to U.S. Provisional Application No. 62/501,367, filed on May 4, 2017, which is incorporated herein in its entirety.

FIELD

Disclosed embodiments are related to door handles used to open doors, and more particularly to door handles having an electronic lock.

BACKGROUND

Door handles are used to open doors. Typical door handles are graspable by a user to actuate the handle, retracting a latch from a recess in a door jamb and allowing the user to open the door. Interior residential door handles may also include a privacy lock set, such as those found on bathroom doors or bedroom doors. Such door handles include a lock that is lockable from the inside of the door and a key hole or pin hole located on the outside of the door. Some locks and associated key holes/pin holes may be located in the door handle, or on the door lock set, but not within the door handle itself.

SUMMARY

In one embodiment, an electronic door lock is provided for a door having at least a first side. The door lock comprises a user-graspable handle configured to be mounted at the first side of the door, an interface mounted to the user-graspable handle, a controller operatively connected to the interface, and a keyless lock device operatively coupled to the controller. The interface is configured to receive one or more credentials provided by and/or associated with one or more users. The controller is configured to receive a signal from the interface corresponding to each credential and to verify the credential and to instruct the lock device to unlock in response to verification of the credential.

In another embodiment, an electronic door lock is provided for a door having at least a first side. The door lock comprises a user-graspable handle mountable to the first side of the door, an interface mounted to the user-graspable handle, a controller operatively connected to the interface, and a lock device operatively coupled to the controller. The interface is configured to detect one or more gestures by one or more users and generate a signal corresponding to each gesture. The controller is configured to receive the signal from the interface corresponding to the gesture and instruct the lock device to unlock in response to the gesture.

In yet another embodiment, a method is provided of operating a door knob mounted to a door. The method comprises acts of: (a) inputting a credential into an interface that is mounted to the door knob, (b) inputting a gesture into the interface, and (c) opening the door by rotating the door knob. The credential is provided by and/or associated with a user. The gesture includes a swiping motion that mimics a rotation of the knob.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
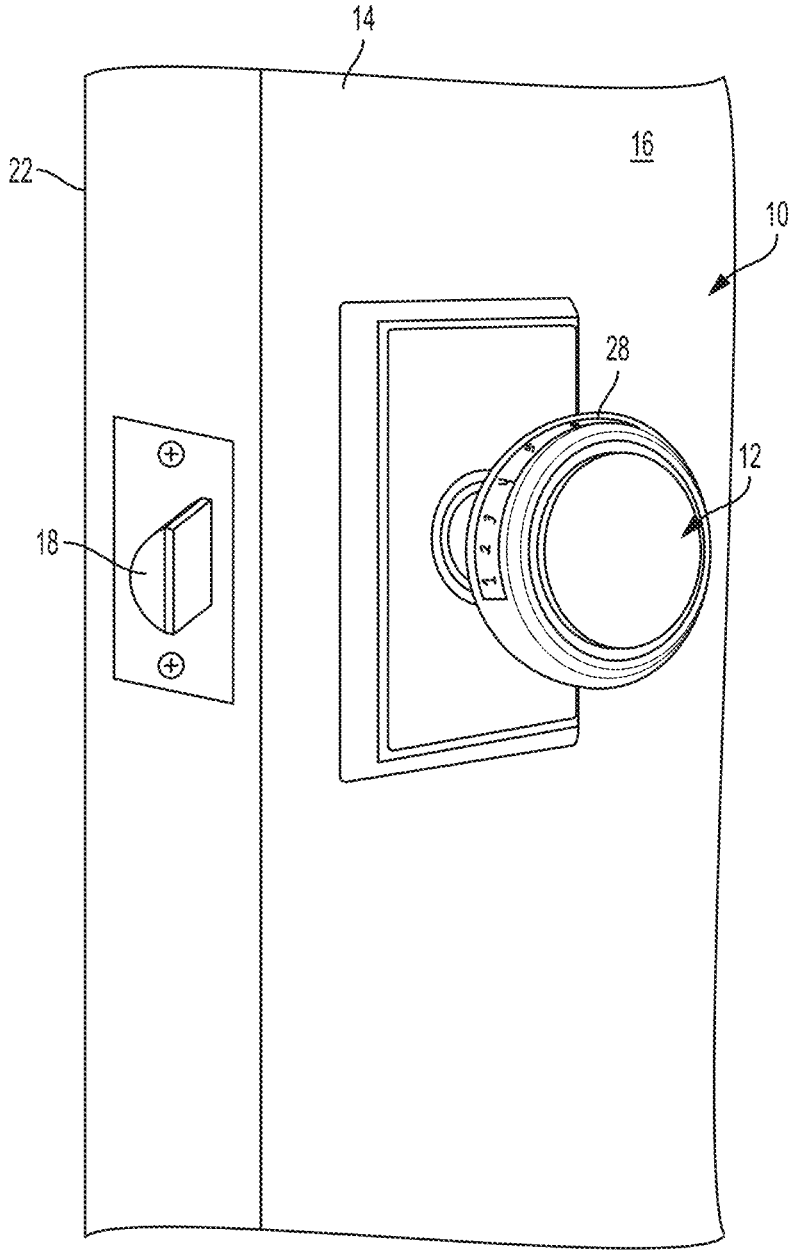
FIG. 1 is a schematic perspective view of an exterior side of a door handle according to one embodiment.

The inventors have recognized and appreciated the drawbacks associated with conventional door handles that use conventional locks. When engaged, the lock prevents the door latch from being retracted from the door frame. Such locks typically require a user to have a key to disengage the lock. For doors that have multiple users, using multiple keys may present a safety issue and an inconvenience if users lose their keys, as all keys would be replaced. Existing keyless solutions such as electronic locks obviate the need for a physical key, but often add additional bulky hardware to a door handle. Accordingly, the inventors have recognized the need for an electronic keyless lock interface that is built into door handle hardware itself, preserving the traditional form factor and size of a door handle. The door lock includes an interface having a sensor that senses a credential. An associated controller commands the door lock to unlock. The door lock may also be connected in a network to give the user greater access and functionality.

The inventors have also recognized and appreciated that a gesture can indicate when a credential is fully input into a door handle interface. The inventor has recognized that after inputting a credential, a user can provide a gesture to prompt the interface to disengage the lock. For example, after inputting a credential, such as a fingerprint or an entry code, the user may make a swiping gesture to submit the credential and prompt the door lock to unlock. One example of a gesture is a rotating motion that mimics rotating a door knob.

In view of the above, the inventors have recognized the advantages of a door handle assembly with a locking interface integrated into otherwise conventional door handle hardware. Such an arrangement provides the accessibility of an electronic keyless door lock without adding additional hardware, that is, within the boundaries of the otherwise conventional door handle. It is to be understood that the term "keyless" means that the door lock is operable without the use of a mechanical key. Furthermore, integrating the locking interface into the door handle may be more aesthetically pleasing than providing a separate interface adjacent the door handle. It should be appreciated that although some embodiments are discussed herein as relating to door locks, the disclosure is not so limited and the inventive concepts may be employed on any lockable barrier.

Turning now to the figures, embodiments of an electronic door lock 10 are shown. Door lock 10 includes an exterior door handle 12 (see e.g., FIGS. 1, 2 and 4); that is, the handle that is mounted to a secured side 14 of a door 16. The electronic door lock is coupled to a latch 18 that must be retracted to open the door. FIG. 3 shows an interior door handle 20, which may be mounted on an unsecured side 22 of the door opposite the secured side 14. In one embodiment, the secured side 14 of the door may face a public space or public areas of a house, while the unsecured side 22 of the door faces a bathroom, a bedroom, closet, or other private space. In the case of a residential home, the public space may be a hallway or other non-private area of a home. As illustrated in FIG. 4, the door lock 10 includes a lock device 24 that prevents the door from being improperly accessed, such that the exterior door handle 12 cannot actuate the latch 18 without first disengaging the lock device 24.

The exterior door handle 12 may have an interface 26 that is configured to controllably engage and disengage the lock device 24 by entering a credential associated with and/or provided by a user. The interface 26 may be mounted on the exterior door handle 12 such that it protrudes from the surface of the door handle. In other embodiments, the interface 26 may be integrated into the exterior door handle 12 such that it is flush with or depressed into the surface of the door handle. In one embodiment, the interface 26 is electrically coupled to the lock device 24.

In the embodiment shown, the exterior door handle 12 is a knob with a circular interface 26 that is positioned in the center of the door handle, although other handle types and interface shapes and positions are possible. With the lock device 24 engaged, the door knob cannot move the latch 18 and open the door. Thus, a user actuates the interface 26 to disengage the lock device 24, such that the knob 12 can be rotated to retract the latch 18.

Figure 2:
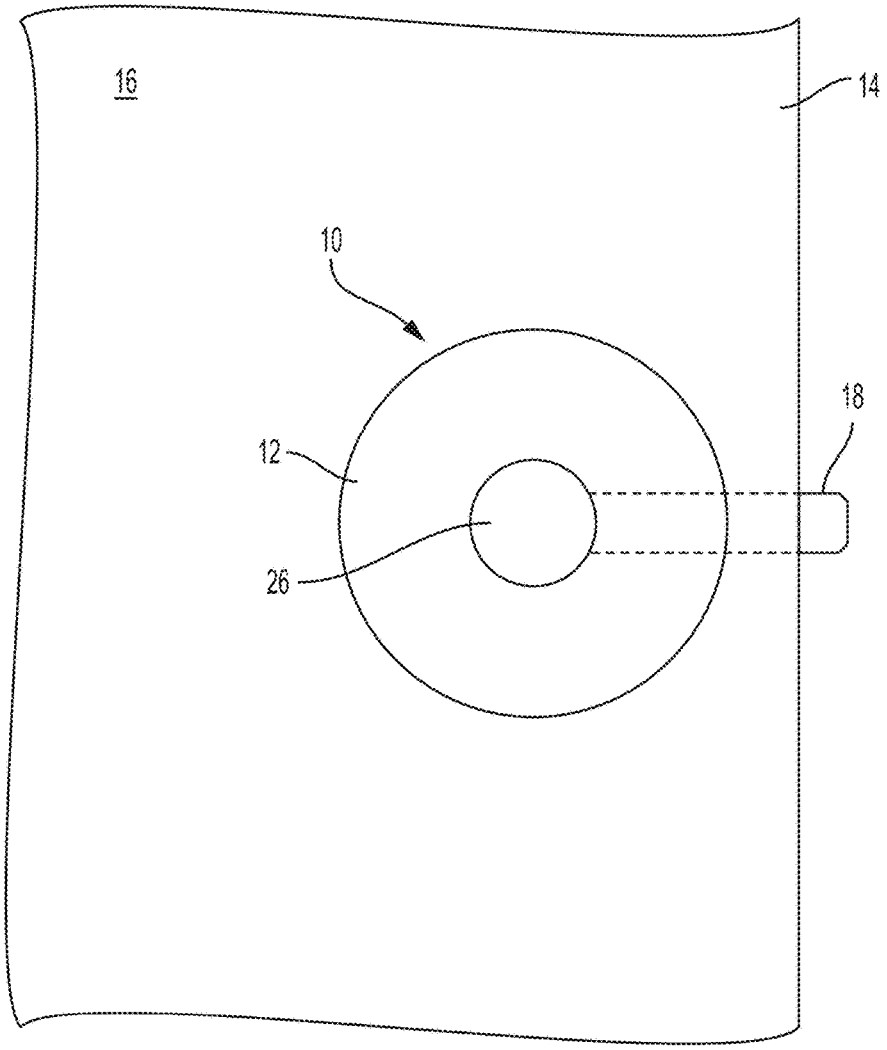
FIG. 2 is a front plan view of an exterior side of a door handle according to one embodiment.
Figure 3:
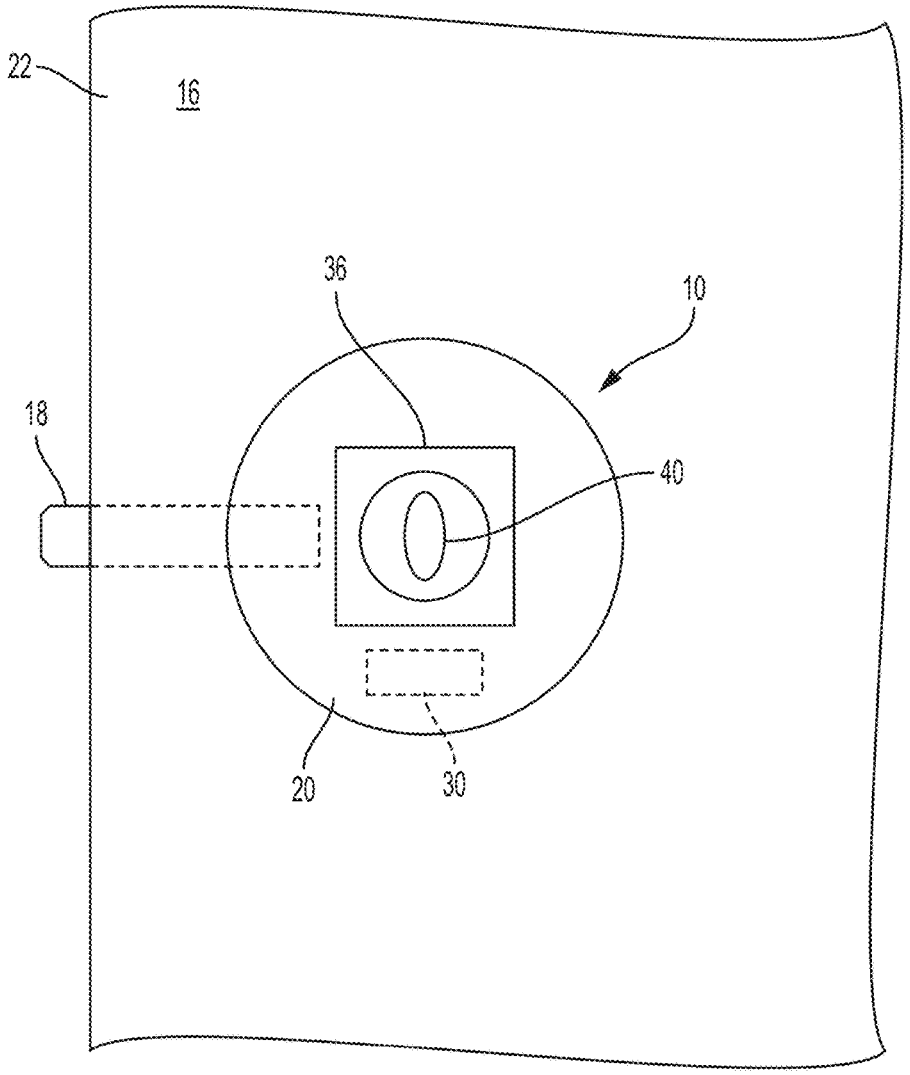
FIG. 3 is a rear plan view of an interior side of a door handle according to the door handle of FIG. 1.
Figure 4:
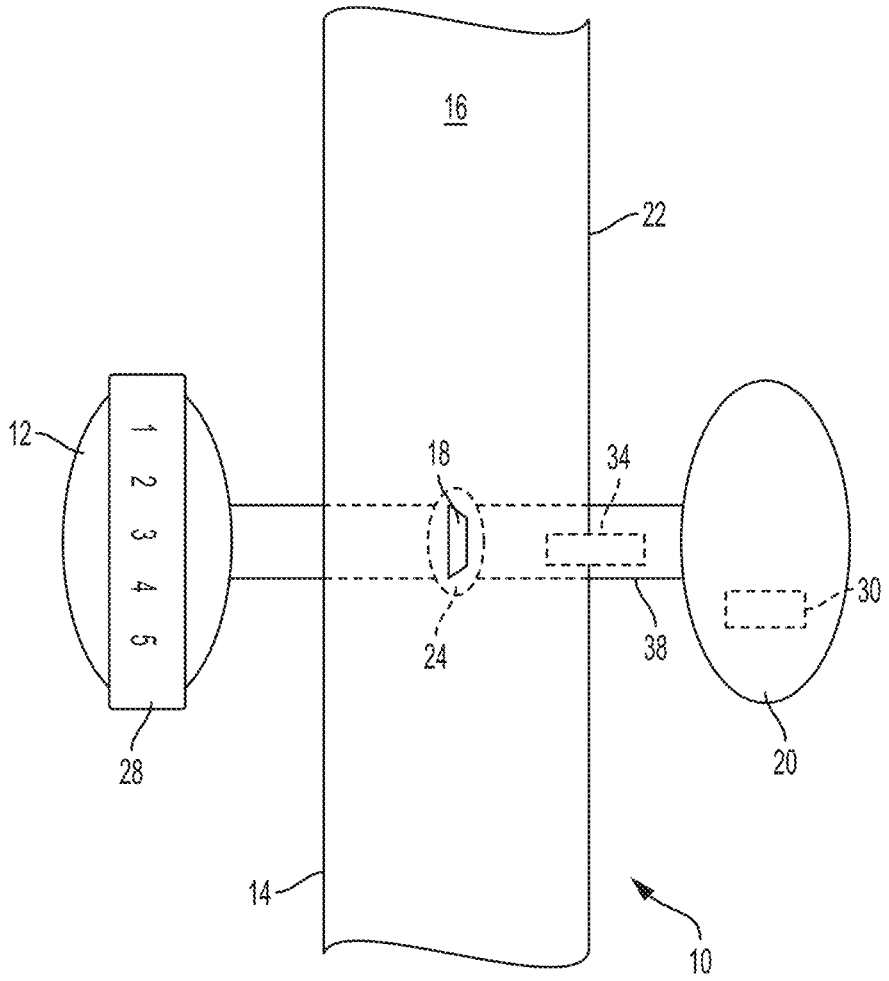
FIG. 4 is a side elevation view of a door handle according to a second embodiment.

FIGS. 2-3 further show the exterior and interior door handles 12, 20 on either side of the door 16 and FIG. 1 shows the exterior door handle 12. In the embodiment shown, the exterior door handle 12 has an interface 26 comprising a sensor strip 28 (FIG. 1) that is mounted to the perimeter of the handle. In other embodiments, the sensor 28 may be located on other regions of the door handle. The sensor 28 may detect a credential, such as a PIN code, a biometric input or a pattern. According to one embodiment, the door handle is configured to be a round knob with a sensor, with the sensor located at least partially around the circumference of the knob, and the sensor can detect fingerprints. In other embodiments, the sensor may detect handprints or other biometric inputs. In one embodiment, the sensor is a touch sensor whereby a user can simply enter a PIN code. Rather than a touch sensor, the interface can be a keypad.

Figure 5:
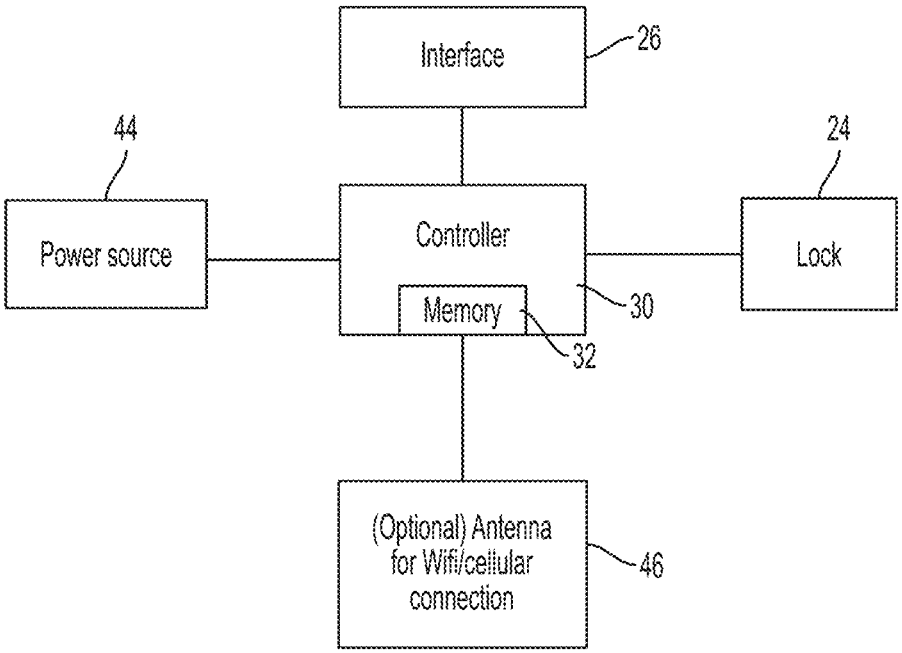
FIG. 5 is a schematic of a control system for a door handle according to a third embodiment.

In one embodiment illustrated in FIG. 5, the door lock 10 includes a controller 30 with an operating system. The controller 30 is configured to receive input from the interface 26. According to one embodiment, the controller 30 has memory 32, which, in addition to its normal function with a controller, is configured to store multiple credentials and for respective multiple users. In another embodiment, the controller may associate multiple credentials with an individual user. For example, a fingerprint, a palm print, and a personal identification number (PIN) may be assigned to an individual user. In some embodiments, the controller 30 may restrict access to certain users or credentials depending on a condition, such as time of day.

The controller 30 may be configured to also enable networked door handles. In one embodiment, the door lock 10 may be connected to a cellular network and/or a wireless network, such that the door lock may be controlled remotely. In one embodiment, a smartphone or laptop may remotely control the door lock 10, monitor the status of the door lock, and lock or unlock the door lock by remotely supplying a credential. In another embodiment, a networked door lock may be connected to a plurality of other doors, such that inputting a credential into an interface 26 unlocks the other door locks. Alternatively, certain credentials may unlock select doors. A single door lock can be considered a master door lock, which can control all other networked doors, or some or all doors may be able to control one another. In another embodiment, the controller may set locking schedule to selectively lock one or more door locks at a given time.

In another embodiment, the interface 26 may comprise a sensor, such as a motion detector, fingerprint sensor, or another appropriate sensor that can accept a credential that disengages the lock device 24. In one embodiment, the interface is a liquid crystal display that is backlit with text or symbols printed on the interface surface. In another embodiment, the interface 26 is a color display that shows text or symbols.

As shown in FIGS. 3-4, the interior door handle 20 may house at least one battery 34 and may include a battery cover 36, which is selectively attached to the interior door handle 20 by threads, a snap fitting, or another appropriate attachment mechanism. The battery supplies power to the electronics (e.g., controller, interface, radio, etc.). As shown in the embodiment of FIG. 4, the battery 34 is housed in the interior door handle shank 38. It is also possible to have multiple batteries in both the interior and exterior door handles 12, 20, or a single battery housing in the exterior door handle 12. The battery cover 36 may cover an opening that is configured to receive at least a AA, AAA, 9V, or another suitable battery type. In some embodiments, it is contemplated that other battery types may be used, or a combination of battery types. In another embodiment, the door handle may be electrically wired, or have a combination of wiring and batteries.

The interior door handle 20 may be configured to be turned to retract the latch 18. In some embodiments, both the interior door handle 20 and exterior door handle 12 have locking interfaces. For example, the interior door handle 20 may include a locking interface that can engage and disengage the lock device 24 from the unsecured side 22. In one embodiment, the physical locking interface comprises a push button or a turn button 40. If the physical locking interface disengages the lock device 24, a user may enter the door from the secured side 14 without a credential. In other embodiments, only the exterior door handle 12 has an interface 26 to unlock the door lock 10, as the secured side 14 of the door may not need to be locked or otherwise have a physical override.

Although the interface 26 has been shown on the exterior door handle 12, the interface may be mounted on the interior or exterior door handle.

According to one embodiment, a credential is a digital code that is input into the interface 26 to disengage the lock device 24. The credential may comprise a code composed of alphanumeric or symbolic characters, a biometric input such as a fingerprint or iris scan, or any suitable combination. In other embodiments, the credential may be any input into the interface 26, such as a series of taps or a pattern traced on the interface. The credential may be unique to an individual user, or may be common to a set of users.

FIGS. 1-2 show an embodiment of an exterior door handle 12 that has an interface comprising a sensor strip 28 with a series of numerals. According to one embodiment, the interface is a single sensor strip, although a plurality of sensors may be employed with each sensor corresponding to a symbol such that a user may input a single code on each sensor. In another embodiment, the numeric code is the same for every user. In other embodiments, each user has a PIN code as a credential. One or more credentials may be stored in the memory. Alternatively, the credential may be stored on a suitable network, such as on a server, where the controller communicates with the server to verify the credential.

According to another embodiment, the interface 26 may unlock the door in response to credentials such as a radio frequency identification (RFID) tag, a Bluetooth device, or a near-field communication (NFC) device. In such an embodiment, the interface is a reader. In one embodiment, an interface may detect an RFID tag, prompting the lock device 24 to disengage. In another embodiment, a Bluetooth or NFC device such as a smartphone, headphones, or car keys may be coupled to the interface, prompting the door to unlock when the Bluetooth or NFC is detected within range of the interface. A Bluetooth or NFC device may be previously paired to the interface, such that the interface automatically unlocks the door lock when a paired device is detected within a predetermined distance or range of distances, including 25 feet, 10 feet, 5 feet, or 2 feet of the door, although other ranges are possible. In one embodiment, the interface may accept a multitude of credentials, such as at least one of biometrics, NFC devices and RFID tags, or other combinations.

The controller 30 may also provide different functionalities depending on the credential type. For example, the controller may only unlock a door lock for a predetermined time period for RFID tags, while a biometric credential would unlock a door lock indefinitely until relocked by the user.

In one embodiment, the interface 26 may further recognize gestures, which may be paired with credentials to unlock the door lock. In one embodiment, a gesture comprises a predetermined motion that is entered after a credential. A gesture input to the interface may indicate to the controller that the credential has been completed. Alternatively, a gesture may prompt the controller to validate the credential and unlock the lock device 24. In another embodiment, the controller validates the credential automatically, and the gesture merely causes the lock device 24 to unlock. In one embodiment, the controller may not require a gesture after detecting an RFID, Bluetooth, or NFC credential.

In one embodiment, the gesture may be a movement that mimics rotating the knob. That is, a user grasps the door knob, specifically the sensor 28, and with a turning motion as if to open or rotate the knob, swipes his or her fingers or hand over the sensor and the door lock 10 unlocks. In one embodiment, a gesture may be reversible, such that entering a credential and swiping a finger or hand in a first direction causes the lock device 24 to unlock whereas swiping a finger or hand in a second direction opposite the first direction may cause the lock device 24 to lock.

In one embodiment, a gesture is a motion detected by a touch-sensitive surface. In another embodiment, the gesture is a plurality of taps detected by a sensor or a single press of a button. In another embodiment, a gesture is a combination of motions, taps, or other suitable inputs. The gesture may be entered into the interface using the same sensors as the credentials, or may use a separate surface or engagement feature.

According to one embodiment, the gesture is a universal motion that is entered after every credential, or may vary depending on different types of users or credentials. For example, different gestures may be used for fingerprint credentials and codes. Different gestures may also be used to control the settings of the lock device 24 after the door has been opened. In one embodiment, one gesture may unlock the lock device 24 and keep it disengaged until a user manually re-locks the lock device. In another embodiment, a second gesture may unlock the lock device 24 and the lock device may automatically re-lock after a time interval. Following the input of a credential and a gesture, the lock device 24 may unlock and a user can turn the door handle to open the door. It should be appreciated that rather than a gesture, the door lock 10 can include a button or other sensor or location on the sensor 28 that is required to be pressed by the user to cause the door lock to unlock.

In one embodiment, the door handle is connected to the latch 18, such that actuating the door handle retracts the latch and enables the door to be opened. The door lock may include an electromechanical blocking element that engages or disengages with a corresponding feature of the lock device 24. In one embodiment, the electromechanical blocking element is actuated by a suitable motor, such as a rotary motor with or without an associated gear train, or a linear motor, such as a solenoid. In one embodiment, a clutch arrangement is actuated by the motor that selectively retracts the blocking element, allowing the door to be opened. In one embodiment, the door lock 10 includes a motorized latch whereby the motor retracts the latch 18 without the need for the user to actuate the handle. When the clutch is in the disengaged configuration, the motor may be disengaged from the lock device 24 such that the lock device remains engaged and the door cannot be opened.

The above-described embodiments can be implemented in any of numerous ways. For example, the embodiments may be implemented using hardware, software or a combination thereof. When implemented in software, the software code can be executed on any suitable controller, whether provided in a single computing device or distributed among multiple computing devices. FIG. 5 shows a schematic of a control system for an electronic lock, according to one embodiment. The interface 26 may be connected to the controller 30, which receives power from a power source 44. In one embodiment, the power source is a battery, an electrical outlet, or another suitable source. The controller 30 may receive input from the interface 26, which is used to engage and disengage the lock device 24. In one embodiment, the controller includes a suitable radio connected to an antenna 46 that transmits or receives signals to a network of one or more doors. In another embodiment, the network is comprised of a system that is connected to smart devices, the internet, or any combination of suitable network components. For example, the controller 30 may request a credential from a remote device to disengage the lock device 24. After having received such credential, the lock device 24 may be unlocked. In yet another embodiment, the controller does not have radio and associated antenna and is not networked.

It should be appreciated that any component or collection of components that perform the functions described above can be generically considered as one or more controllers that control the above-discussed functions. The one or more controllers can be implemented in numerous ways, such as with dedicated hardware, or with general purpose hardware (e.g., one or more processors) that is programmed using microcode or software to perform the functions recited above. In some embodiments, a combination of programmable hardware and dedicated hardware may also be used.

In this respect, it should be appreciated that one implementation of the embodiments described herein comprises at least one computer-readable storage medium (e.g., RAM, ROM, EEPROM, flash memory or other memory technology, CD-ROM, digital versatile disks (DVD) or other optical disk storage, magnetic cassettes, magnetic tape, magnetic disk storage or other magnetic storage devices, or other tangible, non-transitory computer-readable storage medium) encoded with a computer program (i.e., a plurality of executable instructions) that, when executed on one or more processors, performs the above-discussed functions of one or more embodiments. The computer-readable medium may be transportable such that the program stored thereon can be loaded onto any computing device to implement aspects of the techniques discussed herein. In addition, it should be appreciated that the reference to a computer program which, when executed, performs any of the above-discussed functions, is not limited to an application program running on a host computer. Rather, the terms computer program and software are used herein in a generic sense to reference any type of computer code (e.g., application software, firmware, microcode, or any other form of computer instruction) that can be employed to program one or more processors to implement aspects of the techniques discussed herein While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

For example, the locking interface may be used in cooperation with a conventional key or other suitable pin to unlock the door lock, as the present disclosure is not limited in this respect. Thus, a user can choose to use a physical key or input credentials to unlock the door lock.

What is claimed is:

1. An electronic door lock for a door having at least a first side, the door lock comprising:

a user-graspable handle configured to be mounted at the first side of the door;

an interface located on the user-graspable handle, wherein the interface is configured to receive one or more credentials provided by or associated with one or more users;

a controller operatively connected to the interface, the controller configured to receive a signal from the interface corresponding to each credential and to verify the credential; and a keyless lock device operatively coupled to the controller, wherein the controller is configured to instruct the keyless lock device to unlock in response to verification of the credential.

2. The door lock of claim 1, wherein the interface includes either one or both of a touch sensor or a motion detector.

3. The door lock of claim 1, wherein the credential includes any one or combination of an alphanumeric code, symbolic code or a biometric input.

4. The door lock of claim 3, wherein the biometric input includes any one or combination of a fingerprint, a palm print or an iris scan.

5. The door lock of claim 1, wherein the interface is located on a perimeter of the handle.

6. The door lock of claim 1, wherein the interface is configured to detect any one or combination of a radio frequency identification (RFID) tag, a Bluetooth device or a near-field communication (NFC) device.

7. The door lock of claim 6, wherein the user-graspable handle is configured as a round door knob, the interface extending at least partially around the circumference of the door knob.

8. The door lock of claim 6, wherein the interface is configured to detect a paired device within 25 feet of the door lock.

9. The door lock of claim 1, wherein the controller is configured to communicate with a network.

10. The door lock of claim 1, wherein the controller is configured to, either alone or in any combination, communicate with either one or both of a cellular network or a wireless network, be remotely monitored or operated by a remote device, or be networked to a plurality of other door locks.

11. The door lock of claim 10, wherein the controller is configured to control the plurality of other door locks.

12. The door lock of claim 1, wherein the interface is flush with the surface of the door handle.

13. The door lock of claim 1, wherein the controller is configured to instruct the lock device in response to receiving a signal from the interface corresponding to a gesture after receiving the signal from the interface corresponding to the credential.

14. An electronic door lock for a door having at least a first side, the door lock comprising:

a user-graspable handle mountable to the first side of the door;

an interface located on the user-graspable handle, wherein the interface is configured to detect one or more gestures by one or more users and generate a signal corresponding to each gesture;

a controller operatively connected to the interface, the controller configured to receive the signal from the interface corresponding to the gesture; and a lock device operatively coupled to the controller, wherein the controller is configured to instruct the lock device to unlock in response to the gesture.

15. The door lock of claim 14, wherein the one or more gestures include a swiping motion.

16. The door lock of claim 14, wherein the interface is configured to receive the one or more gestures after a credential is input to the interface.

17. The door lock of claim 16, wherein the interface is configured to receive input of the credential and the one or more gestures on a single sensor.

18. The door lock of claim 14, wherein the interface is configured to detect a credential is fully input into the interface in response to the one or more gestures.

19. The door lock of claim 14, wherein the controller is configured to instruct the lock device to unlock in response to a first gesture and instruct the lock device to lock in response to a second gesture, wherein the second gesture is a reverse of the first gesture.

20. The door lock of claim 14, wherein interface includes a touch-sensitive surface.

21. The door lock of claim 14, wherein the user-graspable handle includes a round knob and the one or more gestures include a swiping motion that mimics a rotation of the knob.

22. A method of operating a user-gripable door knob mounted to a door, the method comprising acts of:

(a) inputting a credential into an interface that is located on the door knob, the credential being provided by or associated with a user;

(b) inputting a gesture into the interface, wherein the gesture includes a swiping motion that mimics a rotation of the knob;

(c) sending a signal associated with either one or both of the credential or the gesture from the interface to a controller;

(d) unlocking a keyless lock device in response to verification by the controller of the either one or both of the credential or the gesture; and (e) opening the door by rotating the door knob.

23. The method of claim 22, further comprising acts of:

(f) verifying the credential input to the interface prior to act (d).

24. The method of claim 22, wherein act (b) occurs after act (a).

25. The method of claim 22, wherein act (a) includes any one or combination of inputting an alphanumeric code, a symbolic code or a biometric input.

26. The method of claim 25, wherein act (a) includes any one or combination of inputting a biometric input using a finger print, a palm print or an iris scan.

* * * * *